US007121345B2

(12) United States Patent
Bartlett

(10) Patent No.: US 7,121,345 B2
(45) Date of Patent: Oct. 17, 2006

(54) SUBSEA TUBING HANGER LOCKDOWN DEVICE

(75) Inventor: Christopher D. Bartlett, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 79 days.

(21) Appl. No.: 10/898,460

(22) Filed: Jul. 22, 2004

(65) Prior Publication Data

US 2005/0051336 A1 Mar. 10, 2005

Related U.S. Application Data

(60) Provisional application No. 60/489,376, filed on Jul. 23, 2003.

(51) Int. Cl.
*E21B 29/12* (2006.01)

(52) U.S. Cl. ..... 166/345; 166/344; 166/364

(58) Field of Classification Search ..... 166/341–345, 166/364

See application file for complete search history.

(56) References Cited

U.S. PATENT DOCUMENTS 3,151,892 A * 10/1964 Word, Jr. et al. ..... 285/123.2
3,489,439 A * 1/1970 Word, Jr. ..... 285/123.9
3,606,393 A * 9/1971 Huntsinger et al. ..... 285/90
3,741,294 A * 6/1973 Morrill ..... 166/367
4,214,778 A * 7/1980 Diehl ..... 285/39
4,650,226 A * 3/1987 Babbitt et al. ..... 285/348
4,770,250 A * 9/1988 Bridges et al. ..... 166/382
4,978,147 A 12/1990 Henderson, Jr. et al.
5,341,885 A 8/1994 Bridges
6,053,253 A * 4/2000 Nicholson ..... 166/368
6,253,854 B1 * 7/2001 Fenton ..... 166/364
6,364,024 B1 4/2002 Dallas
2002/0011336 A1 1/2002 Baskett et al.
2002/0162663 A1 * 11/2002 Hemphill ..... 166/373
2003/0019632 A1 1/2003 Humphrey et al.

FOREIGN PATENT DOCUMENTS

EP 0 520 744 A1 12/1992
GB 2 381 023 A 4/2003

* cited by examiner

*Primary Examiner*—Thomas A Beach
(74) *Attorney, Agent, or Firm*—Henry C. Query, Jr.

(57) ABSTRACT

A lockdown device for securing a tubing hanger to a production member comprises a lockdown member which is mounted on the production member and is movable into and out of engagement with a corresponding locking profile on the tubing hanger, and an actuating mechanism for moving the lockdown member into and out of engagement with the locking profile.

16 Claims, 4 Drawing Sheets

SUBSEA TUBING HANGER LOCKDOWN DEVICE

BACKGROUND OF THE INVENTION

The present invention relates to a device for locking a tubing hanger to a tubing spool or the like in a subsea completion system. More particularly, the invention relates to such a device which is operable independently of both the tubing hanger and the tubing hanger running tool.

A typical prior art completion system for subsea oil and gas wells comprises a subsea wellhead which is installed at the upper end of a well bore, a production member which is connected to the top of the wellhead, and a tubing hanger which is landed in the production member and which supports a production tubing string that extends through the well bore and into the well. During installation and workover operations, the subsea completion system is often connected to a surface vessel through a low pressure riser which in turn is connected to a subsea blowout preventor ("BOP") that is secured to the top of the production member.

The tubing hanger is normally installed in the production member using a tubing hanger running tool ("THRT"). In addition, once the tubing hanger is landed in the production member, a lockdown mechanism is usually actuated to secure the tubing hanger to the production member. A typical lockdown mechanism includes a lock ring which is supported on the tubing hanger and is expandable into locking engagement with a corresponding groove that is formed in the production member. Furthermore, once the tubing hanger is secured to the production member, a release mechanism on the THRT is actuated to release the tubing hanger from the THRT.

Thus, prior art THRT's must usually include a lockdown tool for actuating the lockdown mechanism on the tubing hanger and a release tool for actuating the release mechanism on the THRT. Moreover, these tools are often operated by hydraulic pressure which is supplied to the THRT through a hydraulic umbilical that is connected to the surface vessel.

When employing such a hydraulically operated THRT, however, safety and contingency concerns often require that a subsea test tree ("SSTT") and a shear joint also be used. In this arrangement, the SSTT is connected to the top of the THRT, the shear joint is connected to the top of the SSTT, and the entire assembly is lowered on a running string through the low pressure riser and the BOP. In addition, the hydraulic umbilical for the THRT is run along side the running string and then routed to the THRT through the shear joint and the SSTT.

The SSTT and the shear joint allow for a controlled shut-in of the well in the event of a blowout or other emergency. When such an event occurs, the valves in the SSTT are closed, the lower BOP pipe rams are sealed around the SSTT and, if necessary, the upper BOP shear rams are actuated to sever the shear joint and thereby separate the running string from the SSTT. After the well has been brought back under control, the lower portion of the severed shear joint can be retrieved and a replacement shear joint then re-connected to the SSTT.

Thus, the SSTT and the shear joint allow for hydraulic control of the THRT to be easily re-established. Once the replacement shear joint is connected to the SSTT, the hydraulic umbilical is again connected with the THRT. Without the SSTT and the shear joint, the BOP shear rams would sever the hydraulic umbilical and control of the THRT would be lost. Depending on the status of the tubing hanger lockdown and release mechanisms when control is lost, this can be a very costly and time consuming problem to fix.

Wile adequate for many applications, prior art hydraulically operated THRT's have several disadvantages which have become more problematic as subsea wells are drilled in deeper and deeper waters. First, hydraulic umbilicals are subject to collapse due the extreme hydrostatic pressures experienced at great depths. This can result in a temporary or permanent loss of control of the THRT or, in the worst case, a premature release and consequent dropping of the tubing hanger and the production tubing into the well.

Second, some operators prefer to use a surface BOP and a smaller diameter high pressure riser to connect the surface vessel to the production member in deep water. In this arrangement, the hydraulic umbilical for the THRT is routed through a "slick joint" in the running string which is positioned in the surface BOP. However, this requires that the umbilical be cut to a precise length in order to properly "space out" the slick joint, and this can be a difficult and expensive undertaking.

Third, as wells are drilled in progressively deeper waters, the use of "slimbore" completion systems is becoming increasingly popular. These systems comprise production members which have relatively small drift diameters. Consequently, the tubing hangers and THRT's for such systems must have correspondingly small diameters. However, when the tubing hanger lockdown mechanism is supported on the tubing hanger and the lockdown tool is incorporated in the THRT, minimizing the diameter of these components can be a challenge.

SUMMARY OF THE INVENTION

In accordance with the present invention, these and other disadvantages in the prior art are overcome by providing a lockdown device for securing a tubing hanger to a production member. The lockdown device comprises a lockdown member which is mounted on the production member and is movable into and out of engagement with a corresponding locking profile on the tubing hanger. The lockdown device further comprises an actuating mechanism for moving the lockdown member into and out of engagement with the locking profile.

In accordance with one embodiment of the invention, the lockdown member is disposed at least partially in a lockdown port which extends through the production member to the central bore. In accordance with another embodiment of the invention, the lockdown member comprises a stem portion which is disposed in the lockdown port and a base portion which is engaged by the actuating mechanism.

In accordance with a further embodiment of the invention, the actuating mechanism comprises an actuator shaft which includes a first end that engages the lockdown member and a second end that is adapted to be engaged by a tool. In yet another embodiment of the invention, the actuator shaft is rotatably supported relative to the production member, and the first end of the actuator shaft is coupled to the lockdown member through a threaded connection. Thus, rotation of the actuator shaft results in translation of the lockdown member relative to the production member. Furthermore, the actuator shaft may be rotated by a suitable tool on a remotely operated vehicle ("ROV").

Thus, the tubing hanger lockdown device of the present invention does not require the use of a hydraulic umbilical. In addition, since the lockdown device is operable independently of the THRT, the THRT does not require a hydraulic umbilical. Consequently, no need exists for an SSTT during installation of the tubing hanger or workover of the well. Furthermore, since the hydraulic umbilical and SSTT can be dispensed with, the production member can be easily and economically connected to a surface vessel using a surface BOP and high pressure riser. Also, because the lockdown device is not mounted on the THRT or the tubing hanger, the diameter of these components can be greatly reduced so that they can be readily used in slimbore systems.

These and other objects and advantages of the present invention will be made apparent from the following detailed description, with reference to the accompanying drawings.

DETAILED DESCRIPTION OF THE PREFERRED EMBODIMENTS

Figure 1:
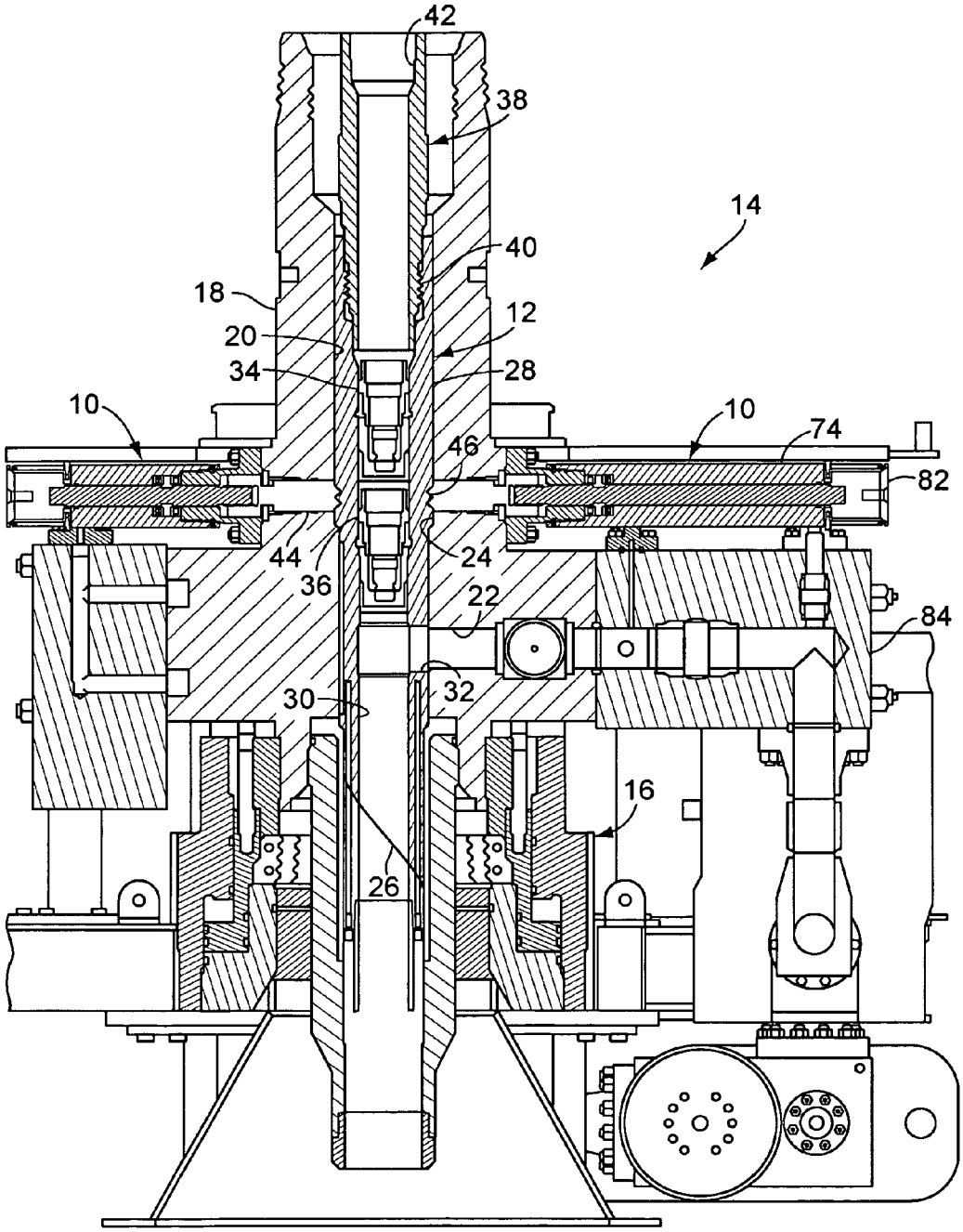
FIG. 1 is a cross sectional view of a subsea completion system comprising a number of tubing hanger lockdown devices in accordance with one embodiment of the present invention.

Referring to FIG. 1, a subsea completion system in accordance with the present invention is shown to comprise a number of novel tubing hanger lockdown devices, generally 10. The lockdown devices 10, two of which are shown, lock a tubing hanger 12 within a production member 14 which is secured with a conventional connector 16 to the top of a wellhead (not shown). Although the production member 14 is depicted as a horizontal Christmas tree, the lockdown devices 10 could be used in conjunction with any component which is adapted to support a tubing hanger, such as a conventional Christmas tree, a wellhead, a tubing spool, a spool tree or an adapter. Therefore, the term production member should be interpreted to include all such components.

The production member 14 includes a body 18, a central bore 20 which extends axially through the body, a production outlet 22 which extends laterally through the body from the production bore, and a tubing hanger landing shoulder 24 which is formed in the central bore. In accordance with one embodiment of the present invention, the production member 14 ideally also includes an orientation helix 26 which is formed in either the central bore 20 or on an orientation sleeve which is attached to the central bore.

The tubing hanger 12 is supported in the central bore 20 on the landing shoulder 24. In addition, the tubing hanger 12 includes a generally cylindrical body 28, a production flowpath 30 which extends axially through the body, and a production port 32 which extends generally laterally between the production flowpath and the production outlet 22. During certain modes of operation of the subsea completion system, the production flowpath 30 may be sealed above the production port 32 by one or more wireline plugs 34, 36.

The tubing hanger 12 is installed in the production member 14 using a THRT 38, which is ideally connected to the tubing hanger with threads 40 and to a running string (not shown) with threads 42. As the tubing hanger 12 is landed in the central bore 20, an orientation key on the tubing hanger engages the orientation helix 26 and forces the tubing hanger to rotate until the production port 32 is aligned with the production outlet 22. Once the tubing hanger 12 has been landed on the landing shoulder 24, it can be locked to the production member 14 with the lockdown devices 10.

Figure 2:
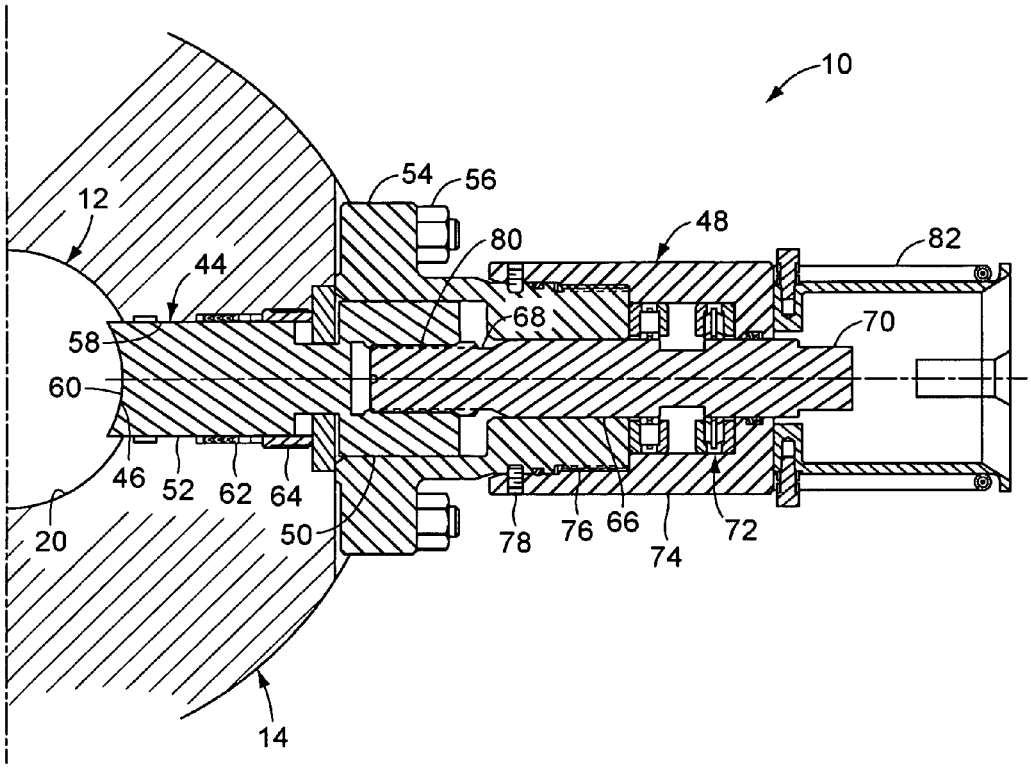
FIG. 2 is a top cross sectional view of one of the tubing hanger lockdown devices of FIG. 1.

Referring to FIG. 2, each lockdown device 10 comprises a lockdown member 44 which is adapted to engage a corresponding locking profile 46 that is formed on the outer diameter of the tubing hanger 12 (as shown best in FIG. 1), and an actuating mechanism 48 which functions to move the locking member into and out of engagement with the locking profile. In accordance with the present invention, the lockdown member 44 can comprise any appropriate pin, screw, dog, segment, collet, ring or the like. Also, the actuating mechanism 48 can comprise any suitable screw, cam, toggle, shaft or the like which is translated or rotated by a corresponding electric, hydraulic or manual linear or rotary actuator. In addition, the actuating mechanism 48 can ideally be operated either remotely from a surface vessel or directly by a diver or an ROV.

In the embodiment of the invention which is illustrated in FIG. 2, the lockdown member 44 comprises a locking segment which includes a base portion 50 that is attached to or formed integrally with a stem portion 52. The base portion 50 is slidably supported in a bonnet 54 which is attached to the production member 14 by suitable means, such as a number of stud and nut assemblies 56. The stem portion 52 is disposed in a corresponding lockdown port 58 which extends generally laterally through the production member 14 to the central bore 20. In addition, the stem portion 52 includes a distal end which comprises a lockdown profile 60 that is adapted to engage the locking profile 46 on the tubing hanger 12. Furthermore, the stem portion 52 is ideally sealed to the lockdown port 58 by a suitable sealing assembly, such as a packing 62 which is held in place by a gland nut 64.

The actuating mechanism 48 is shown to comprise an actuator shaft 66 which includes a first end 68 that engages the lockdown member 44 and a second end 70 that is adapted to be engaged by a suitable tool, such as a rotary tool on an ROV (not shown). In this embodiment, the actuator shaft 66 is rotatably supported on the bonnet 54 through a suitable bearing assembly 72 which is disposed in a housing 74 that in turn is connected to the bonnet with, for example, threads 76 and one or more set screws 78. In addition, the first end 68 of the actuator shaft 66 is coupled to the base portion 50 of the lockdown member 44 through a threaded connection 80. Thus, rotation of the actuator shaft 66 will result in translation of the lockdown member 44 relative to the production member 14. In this regard, suitable means are ideally provided to prevent the lockdown member 44 from rotating in the lockdown port 58. The design and implementation of such means are within the knowledge of the person of ordinary skill in the art and therefore do not require further explanation.

The lockdown device 10 may also include an ROV bucket 82 to help guide an ROV rotary tool into engagement with the actuator shaft 66. In addition, the actuator shaft 66 and the housing 74 may be extended to any length to enable the ROV to easily access the ROV bucket 82. For example, as shown in FIG. 1, the actuator shaft 66 and housing 74 of the right-hand lockdown device 10 have been extended to clear the wing valve block 84. Alternatively, the actuator shaft 66 may be rotated by a diver or by any suitable rotary motor.

When it is desired the actuate the lockdown device 10, the actuator shaft 66 is rotated to cause the lockdown member 44 to move radially inward or outward relative to the production member 14. This in turn forces the lockdown profile 60 on the stem portion 52 into or out of engagement with the locking profile 46 on the tubing hanger 12. In this regard, the bearing assembly 72 ideally comprises a thrust bearing to transfer the axial reaction loads from the lockdown member 44 and the actuator shaft 66 through the housing 74 and the bonnet 54 and ultimately to the production member 14.

Thus, once the tubing hanger 12 is landed in the production member 14, the lockdown devices 10 may be actuated to secure the tubing hanger in the central bore 20. After the lockdown members 44 are moved into engagement with their corresponding locking profiles 46 on the tubing hanger 12, the tubing hanger will be prevented from moving upwards in the face of vertical forces which are caused by, for example, pressure in the well bore below the tubing hanger or thermal expansion of the production tubing string which is suspended from the tubing hanger. Furthermore, once the tubing hanger 12 is locked in place, the THRT 38 can be released from the tubing hanger by simply rotating the running string until the threads 42 are disengaged.

The tubing hanger lockdown device 10 offers many advantages over prior art lockdown mechanisms. Since the lockdown device 10 operates independently of the THRT 38, no need exists to supply the THRT with hydraulic pressure. Consequently, the usual hydraulic umbilical which supplies conventional THRT's with hydraulic pressure can be eliminated. In addition, since the THRT 38 does not need a hydraulic umbilical, an SSTT is not required during installation of the tubing hanger 12 or workover of the well.

Figure 3A:
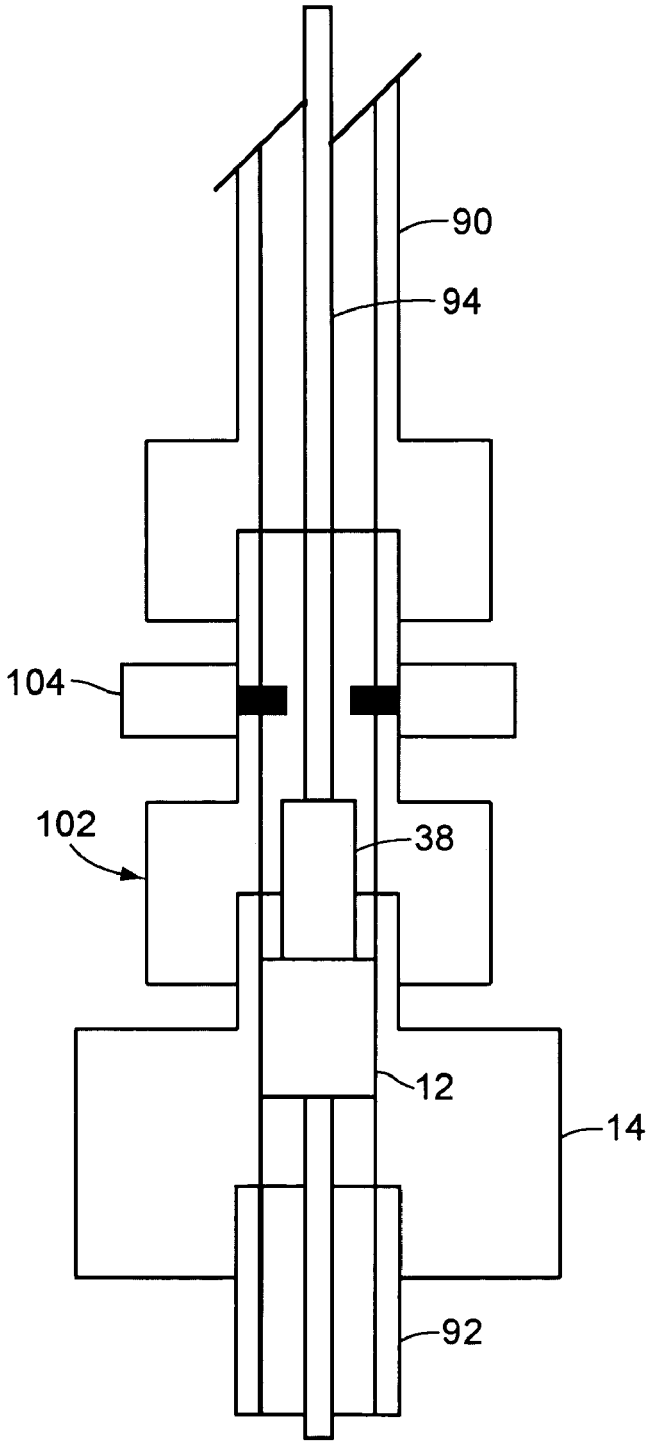
FIG. 3A is a schematic representation of the subsea portion of the completion system shown in FIG. 1.
Figure 3B:
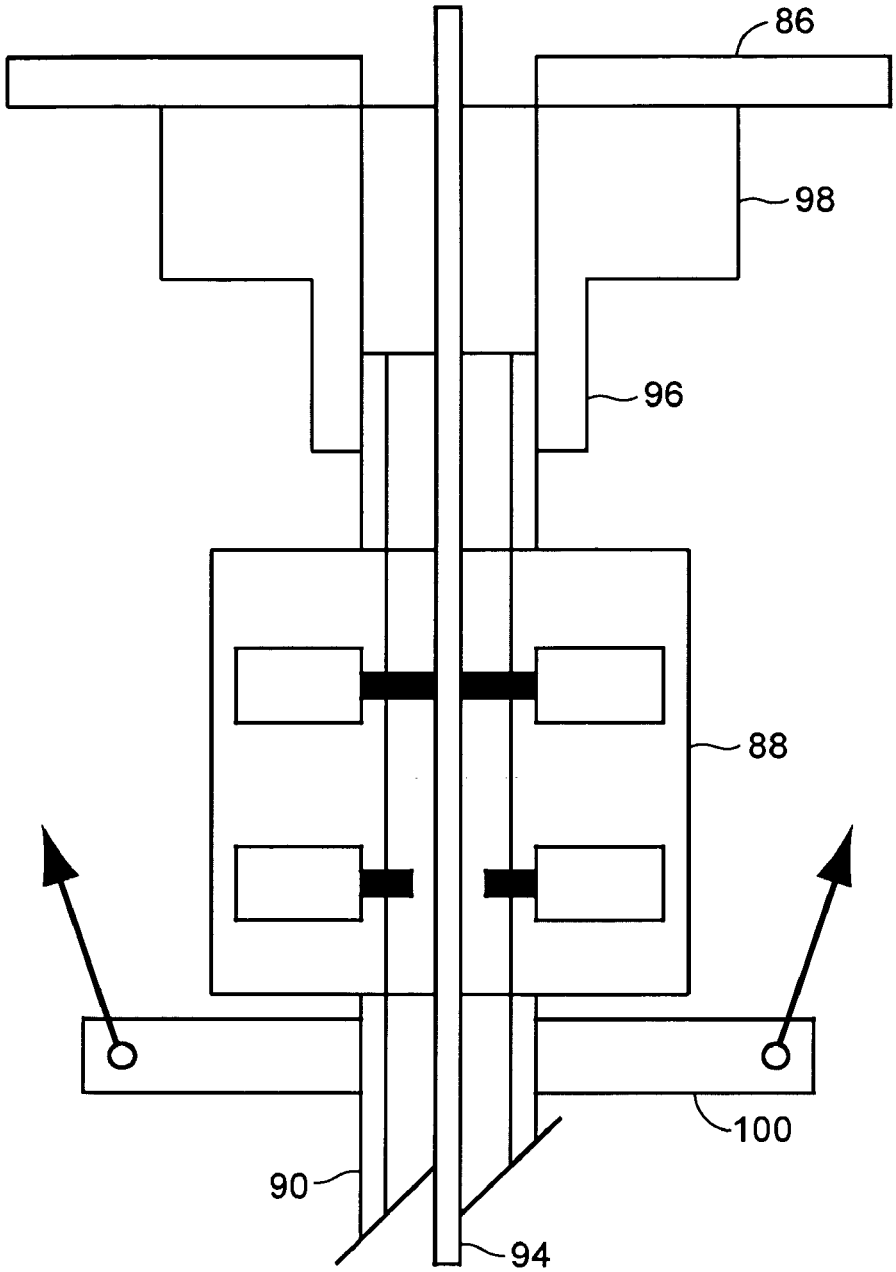
FIG. 3B is a schematic representation of the surface portion of the completion system shown in FIG. 1.

Referring to FIGS. 3A and 3B, the locking device 10 also facilitates the connection of the subsea completion system to a surface vessel 86 using a surface BOP 88 and a small diameter, relatively light weight high pressure riser 90. In this embodiment of the invention, the production member 14 is connected to a wellhead 92 which is installed at the upper end of a well bore (not shown), and the tubing hanger 12 is landed in the production member using a THRT 38 which is connected to a running string 94. In addition, the top of the BOP 88 is ideally connected to a telescopic joint 96 which is attached to a diverter 98 that is supported on the surface vessel 86, and the bottom of the BOP is connected to the top of the riser 90 just above a riser tensioner 100. Furthermore, an optional subsea isolation device 102 comprising shear rams 104 may be positioned between the production member 14 and the riser 90 if desired or required. In this embodiment, since the THRT 38 does not require a hydraulic umbilical, the running string 90 does not need to be provided with a slick joint within the BOP 88.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. In combination with a subsea completion system which includes a subsea wellhead, a production member that is connected to the wellhead and a tubing hanger that is supported within a central bore in the production member, the improvement comprising a tubing hanger lockdown device which comprises:

a lockdown port which extends generally laterally through the production member to the central bore;

at least one lockdown member which includes a stem portion that is positioned in the lockdown port, a base portion that is attached to or formed integrally with a first end of the stem portion, and a lockdown profile that is attached to or formed integrally with a second end of the stem portion;

an actuator shaft which is rotatably supported relative to the production member and which includes a first end that comprises a tool profile and a second end that is threaded to the base portion;

wherein the stem portion is generally restricted from rotating axially within the lockdown port; and wherein rotation of the actuator shaft moves the stem portion axially through the lockdown port and brings the lockdown profile into engagement with a corresponding locking profile on the tubing hanger to thereby secure the tubing hanger in the central bore.

2. The combination of claim 1, further comprising a bonnet which is connected to an outer surface of the production member and which includes a receptacle within which the base portion is positioned.

3. The combination of claim 2, wherein the the bonnet comprises an axial bore which is connected to the receptacle and through which the actuator shaft extends.

4. The combination of claim 3, wherein the actuator shaft is rotatably supported in a bearing assembly which is supported on the bonnet.

5. The combination of claim 4, wherein the bearing assembly is positioned in a housing which is connected to the bonnet.

6. A subsea completion system which comprises:

a subsea welihead which is installed at an upper end of a well bore;

a production member which is connected to the welihead and which comprises a body, a central bore that extends generally axially through the body, and a landing shoulder that is formed in the central bore;

a tubing hanger which is supported on the landing shoulder and which comprises an outer diameter surface and a locking profile that is formed on the outer diameter surface;

a lockdown port which extends generally laterally through the production member to the central bore;

at least one lockdown member which includes a stem portion that is positioned in the lockdown port, a base portion that is attached to or formed integrally with a first end of the stem portion, and a lockdown profile that is attached to or formed integrally with a second end of the stem portion;

an actuator shaft which is rotatably supported relative to the production member and which includes a first end that comprises a tool profile and a second end that is threaded to the base portion; p1 wherein the stem portion is generally restricted from rotating axially within the lockdown port; and wherein rotation of the actuator shaft moves the stem portion axially through the lockdown port and brings the lockdown profile into engagement with the locking profile on the tubing hanger to thereby secure the tubing hanger in the central bore.

7. The subsea completion system of claim 6, further comprising a bonnet which is connected to an outer surface of the production member and which includes a receptacle within which the base portion is positioned.

8. The subsea completion system of claim 7, wherein the bonnet comprises an axial bore which is connected to the receptacle and through which the actuator shaft extends.

9. The subsea completion system of claim 8, wherein the actuator shaft is rotatably supported in a bearing assembly which is supported on the bonnet.

10. The subsea completion system of claim 9, wherein the bearing assembly is positioned in a housing which is connected to the bonnet.

11. The subsea completion system of claim 6, further comprising a THRT which is connected to the tubing hanger and a running string which is connected to the THRT.

12. The subsea completion system of clam 11, wherein the THRT is threadedly connected to the tubing hanger.

13. The subsea completion system of claim 11, further comprising:

a surface BOP which is supported on a surface vessel; and a high pressure riser which includes a first end that is connected to the surface BOP and a second end that is connected to the production member;

wherein the tubing hanger is lowered from the surface vessel to the production member through the surface BOP and the riser.

14. The subsea completion system of claim 13, further comprising an isolation member which is connected between the riser and the production member and which includes a set of shear rams that are capable of shearing the running string.

15. The combination of claim 5, further comprising an ROV bucket which is connected to the housing and through which the tool profile is accessible.

16. The subsea completion system of claim 10, further comprising an ROV bucket which is connected to the housing and through which the tool profile is accessible.

* * * * *